United States Patent [19]

DeLange, III

[11] 4,368,842

[45] Jan. 18, 1983

[54] MAILBOX PROTECTOR

[76] Inventor: William DeLange, III, 5628 Foxboro Trail, Springfield, Mo. 65804

[21] Appl. No.: 142,250

[22] Filed: Apr. 21, 1980

[51] Int. Cl.[3] ..... B65D 91/00

[52] U.S. Cl. ..... 232/17; 232/39

[58] Field of Search ..... 232/17, 35, 38, 39; D26/118, 119; D99/29, 31, 33; 109/49.5; 248/345.1

[56] References Cited

U.S. PATENT DOCUMENTS

| | | | |
|---|---|---|---|
| D. 21,721 | 2/1941 | Steber | D26/119 X |
| 1,823,759 | 9/1931 | Petersen | 232/39 X |
| 1,953,168 | 4/1934 | Geyer | 248/345.1 |
| 1,994,186 | 3/1935 | Anderson | 232/39 |
| 2,635,780 | 4/1953 | Schmidt | D26/119 X |
| 2,911,174 | 11/1959 | Goss | 232/39 UX |
| 3,078,367 | 2/1963 | Jackson | D26/119 X |
| 3,107,848 | 10/1963 | Penta | 232/17 |
| 3,243,104 | 3/1966 | Fillion | 232/39 X |
| 4,187,978 | 2/1980 | Dowker | 232/39 |
| 4,244,512 | 1/1981 | Wise | 232/17 |

*Primary Examiner*—James J. McCall
*Assistant Examiner*—Peter A. Aschenbrenner
*Attorney, Agent, or Firm*—Haverstock, Garrett & Roberts

[57] ABSTRACT

According to the present invention impact damage to a mail box can be prevented entirely or at least minimized to the extent whereby the mail box can still function by enclosing the exterior surface of the mail box in a novel cage constructed of impact resistant material and adapted to be fastened to the mail box standard in such manner that any impact force applied to the cage is primarily transmitted from the cage to the mail box standard. The cage is further characterized by a flexural strength adequate to prevent it upon being subjected to an impact force from indenting or otherwise deforming the mail box surface to an extent preventing satisfactory opening and closing of the mail box door by U.S. Post Office personnel.

4 Claims, 17 Drawing Figures

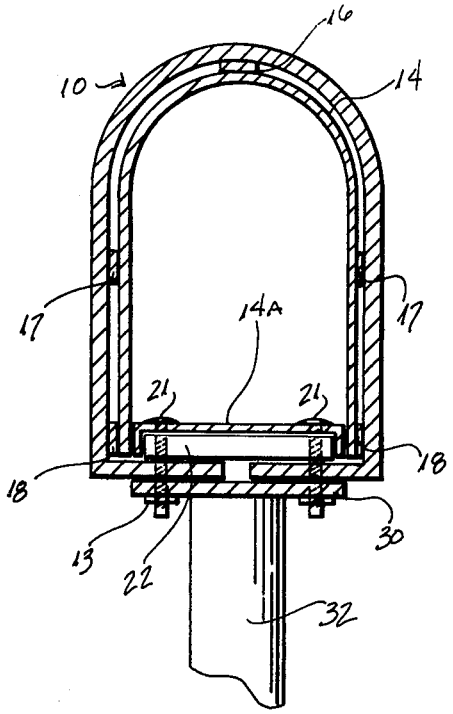
FIG. 9
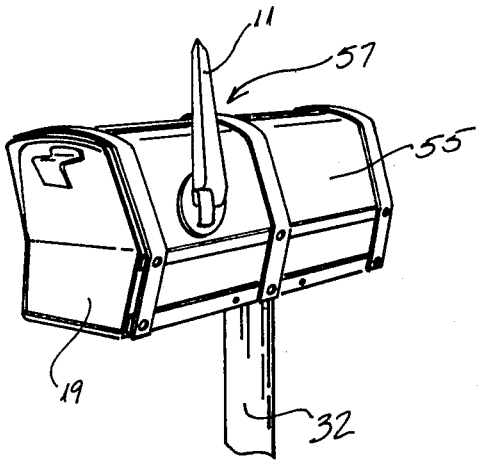
FIG. 10
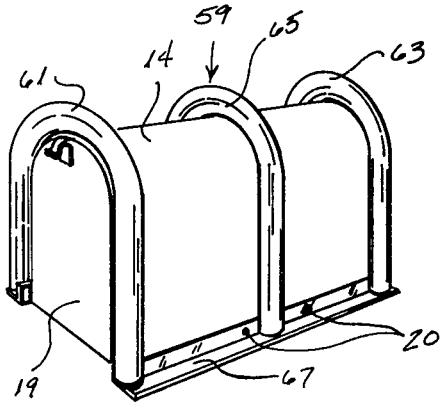
FIG. 11
FIG. 13
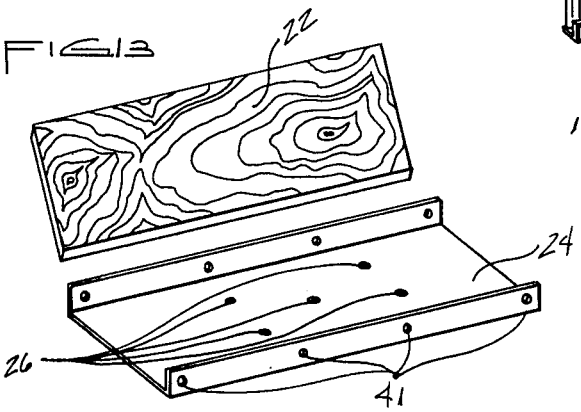
FIG. 14
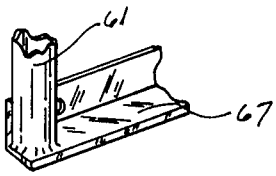
FIG. 12

MAILBOX PROTECTOR

This invention relates to novel constructions for shielding standard mounted rural type or curb side mail boxes from impact damage, which in the absence of such shielding constructions would in many instances impair or destroy the functionality of the mail box and/or result in serious disfigurement of the mail box.

There is no known patent art relating specifically to rigid impact protective shields for rural mail boxes. Manufacturers of USPS approved rural mail boxes apparently have not made any effort on their part to develop a suitable protective device for rural mail boxes and seemingly would prefer supplying new mail boxes to replace those damaged by accidental collision or vandalism. Furthermore, it appears the U.S. Postal Service has not been active in promulgating standards covering impact resistance of rural mail boxes and instead requires replacement of damaged mail boxes, if mail service is to be continued. In some areas of the country experiencing heavy snowfalls, the damage inflicted on rural mail boxes during the winter season by snow plows and automotive vehicles gives rise to an annual spring ritual of mail box replacement. Careless drivers of automotive vehicles also add to the year round toll of damage to rural mail boxes. Vandalism is also a year round occurrence and is difficult to deter. Frequently the vandal uses a baseball bat or similar club like weapon to strike the mail box denting or even crushing the rather thin guage metal (e.g. 22 guage) used in the mail box construction.

The present invention depends on providing a cage constructed of impact resistant material and so configurated as to provide an impact barrier between the impact force and the exterior surfaces of a rural type mail box, said cage being adapted for attachment to the usual standards for rural type mail boxes in such manner that any impact force exteriorly applied to the cage is transmitted primarily to the standard.

It is therefore a principal object of the present invention to provide a cage enclosure capable of preventing physical damage to rural type mail boxes upon being subjected to violent impacts such as would render them unfit for further use for reception of mail deliveries.

A further object is provide a cage enclosure not only capable of preventing damage to the enclosed mail box, but which does not interfere with the normal operation of the box as regards access to the interior of the mail box, opening and closing of the mail box door, operation of the standard carrier signal flag or the door catch.

A still further object is to provide a cage enclosure which can be easily and securely fastened to the usual metal or wood post standard in such manner that upon application of an impact force to the exterior surface of the cage such force is absorbed initially by the cage and concurrently transmitted to the standard with minimum or no energy transfer at all to the enclosed mail box.

Yet another object is to provide a cage enclosure adapted to be fastened as by screws or bolts to a rectangular bolster plate positioned within the usual exterior bottom cavity formed by the corrugated or ribbed bottom of the mail box and the two side flanges at the bottom of the box running from the front to the rear of the box, said bolster plate being adapted for attachment as for example with the aid of screws or bolts to a horizontal wood post or to a horizontal metal mounting plate welded or otherwise secured to the top of a steel post or pipe.

Yet still another object is to provide a preassembled combination of a cage enclosure, a rural type mail box and a bolster plate positioned within the exterior bottom cavity of the mail box, which combination can be readily and securely attached to most any mail box standard in such manner as to provide excellent impact protection to the enclosed mail box.

These and other objects and unique advantages of the present invention will become apparent to those skilled in the art after considering this specification and the accompanying drawings which show and describe several different embodiments of the subject cage constructions.

BRIEF DESCRIPTION OF THE DRAWINGS

In the accompanying drawings, in which are shown various illustrative embodiments of this invention.

FIG. 9 is also a sectional view similar to FIG. 6 and illustrates a further embodiment of a protective cage and means for mounting the cage and enclosed mail box to a mail box standard;

FIG. 10 is a perspective view of a contemporary rural mail box having a protective cage configurated to the external shape of the mail box;

FIG. 11 is a perspective view of a still further embodiment of the invention wherein the cage comprises a plurality of tubular arches with the terminal ends of each arch welded to an angle bar running the length of the mail box.

FIG. 12 is a fragmentary slightly enlarged fragmented perspective view of the front arch in FIG. 11 showing the welded connection between the arch and the angle bar;

FIG. 13 is a perspective view of a bolster plate comprising one component of the mounting means shown in FIGS. 7, 8, and 9;

FIG. 14 is a perspective view of another form of bolster plate comprising one component of the mounting means shown in FIG. 6;

Figure 1:
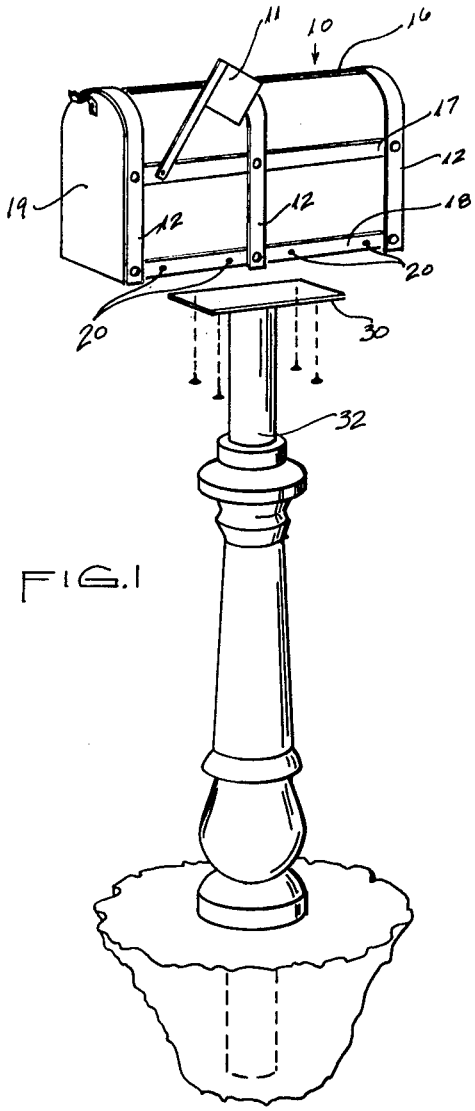
FIG. 1 is a side perspective view of a rural type mail box within a cage enclosure of this invention, as mounted on an ornamental standard.
Figure 2:
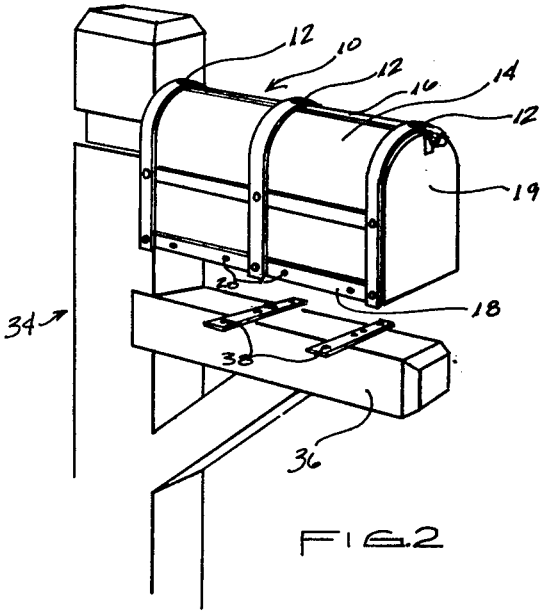
FIG. 2 is a side perspective view of the same rural type mail box and protective cage as in FIG. 1, but with the mail box and cage mounted on a wood post type standard.
Figure 3:
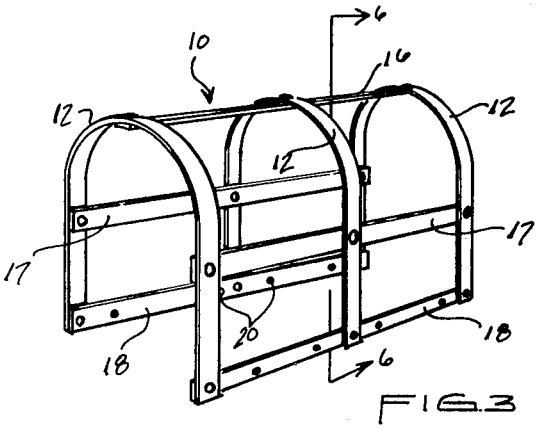
FIG. 3 is a detailed perspective view of the cage shown in FIG. 1 and FIG. 2.
Figure 6:
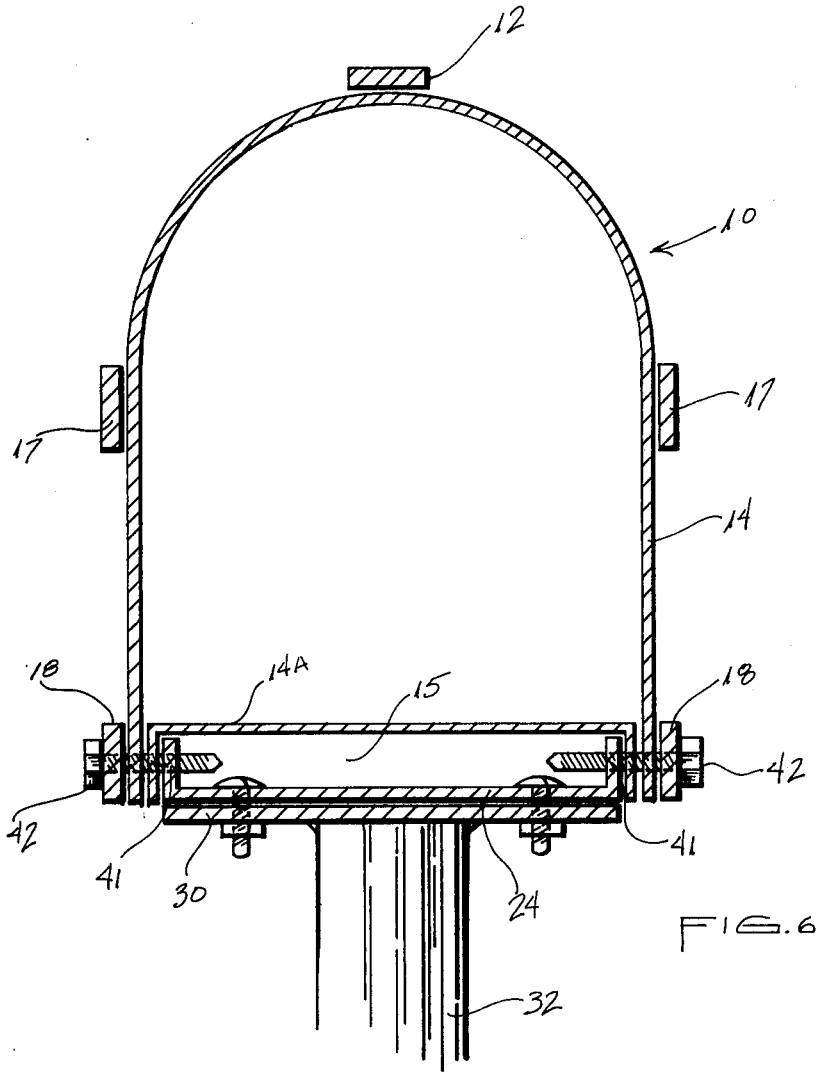
FIG. 6 is a fragmentary sectional view taken along the line 6—6 of FIG. 3 illustrating one of several ways to attach the cage of this invention to a rural mail box and to a mail box standard.

Referring now in detail to the drawing, the presently preferred cage structure is illustrated by FIGS. 1, 2, 3, 6, 16 and 17 and designated as 10 in each instance. As best shown in FIG. 3, the cage 10 comprises a plurality of arched metal bar straps 12 bent or shaped to conform generally to the curvature of the top and parallel sides of rural mail box 14 and a plurality of horizontal straight metal bars comprising one bar 16 adjacent to the uppermost surface of mail box 14, at least one bar 17 on each side of mail box 14 positioned approximately adjacent to the mid-section of the mail box 14, and a bottom bar 18 on each bottom side of mail box 14. Each arched metal bar 12 is securely attached at its cross-overs with horizontal metal bars 16, 17 and 18 by bolts, rivets and/or welding. The length of horizontal metal bars 16, 17, and 18 corresponds substantially to the depth of mail box 14, but if desired can extend some distance beyond each end of mail box 14 to provide additional impact protection against impact forces directed mainly against either end of the mail box. Bottom horizontal bars 18 are provided with drilled or punched apertures 20 mating with apertures in the bottom edge of mail box 14 to enable cage 10 as shown in FIG. 6 to be fastened to a bolster plate 24 positioned as shown in FIG. 6 within the usual cavity 15 at the bottom of mail box 14. The bolster plate 22 as shown in FIGS. 7, 8, 9, and 13 can be a rectangular shaped wood board but preferrably is a highly compressed molded structure of paper or wood fibers heat and pressure bonded by a synthetic resin of the heat hardening type, e.g. a phenolic resin, a urea-formaldehyde resin or a melamine-formaldehyde resin, as such laminates are stronger and more weather resistant than most wood boards. An alternative bolster 24 shown in FIGS. 6 and 14 is a metal stamping or extrusion of a "U" channel shape formed from a suitable metal such as steel, brass, copper or aluminum stock. The base of bolster 24 has apertures 26 drilled or punched therethrough to facilitate attachment of bolster 24 to the usual mounting plate 30 welded or otherwise securely fastened to tubular metal standard 32 as shown in FIG. 1 or to a horizontal wood post as shown in FIG. 2.

Alternatively as shown in FIG. 2, the cage enclosure 10, mail box 14 and either bolster plate 22 or 24 can be attached to a wood post type mail box standard 34 having a horizontal wood support beam 36. Metal straps 38 screw fastened to horizontal post beam 36 to provide a convenient means for screw attachment of straps 38 to the bottom of bolster plate 22, via apertures 39 in straps 38. When instead use is made of "U" shaped bolster plate 24, straps 38 are not required because bolster plate 24 can be directly screw attached to the top surface of horizontal post beam 36 via apertures 26 in bolster plate 24. After bolster plate 24 has been attached to horizontal post beam 36 or to a mounting plate 30 on a steel post as shown in FIG. 6 the mail box 14 and cage 10 are attached to bolster plate 24 by bolts 42 passing through apertures 20 in bottom horizontal metal bars 18 and corresponding apertures along the bottom edge of mail box 14 and then into threaded apertures 41 in the side flanges of bolster plate 24.

Figure 4:
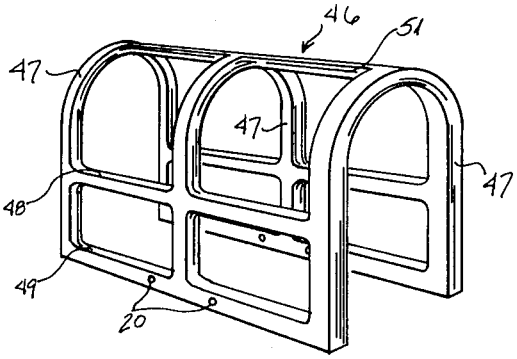
FIG. 4 is a detailed perspective view of another cage embodiment in the form of a ribbed metal or plastic casting or molding.

Referring now to FIG. 4, there is depicted a cage structure 46 similar in principle to that shown in FIG. 3 except that the arch members and the side and top horizontal members are cast or molded into a unitary structure as by die casting or injection molding techniques. Cage structure 46 can be cast from any suitable metal including steel, cast iron, aluminum, magnesium, zinc, brass, or copper. Necessarily in order for a plastic cage structure 46 to possess strength properties equivalent to a cast metal cage, the plastic cage as will be understood by those skilled in the art, will be constructed with thicker and wider cross-sectional areas from a suitable plastic molding material which not only has a high impact strength at summer temperatures, but which does not become brittle at or below freezing temperatures.

In a preferred embodiment of the invention, cage 10 is constructed from cold rolled steel bars having a thickness of from about $\frac{1}{8}$th to $\frac{1}{4}$th inch and a width of from $1\frac{1}{4}$ to 2 inches. Such a cage 10 wherein all structural members 12, 16, 17 and 18 are of these dimensions and material has been found adequate in testing to protect enclosed mail box 14 from being functionally damaged by hand wielded baseball bats or thrown glass bottles to the extent they would not be acceptable for mail delivery by the U.S. Postal Service. Although it was possible to dent the mail box surface in some instances, particularly when the force of the baseball bat was directed and localized against a side surface of mail box 14 not covered by a metal strap, such dents did not interfere with opening and closing of the mail box door 19. Even such denting can be substantially or completely prevented by including in cage structure 10, one or more additional horizontal bar members between top metal bar 16 and bottom metal bar 18.

Figure 5:
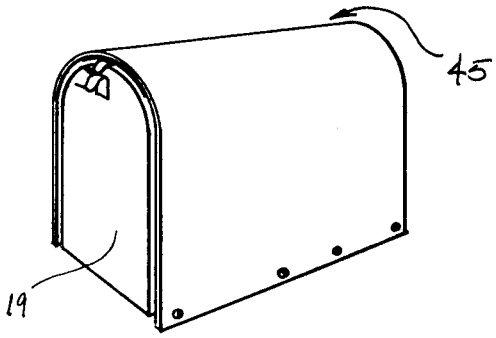
FIG. 5 is a detailed perspective of another cage embodiment utilizing a heavy metal plate shaped to the configuration of a rural type mail box and which additionally offers protection to the enclosed mail box against weather damage such as by sun, rain, sleet and hail.

Maximum protection against any denting of mail box 14 is to be found in the structure 45 depicted in FIG. 5 wherein all side surfaces of mail box 14 are completely shielded by a metal plate cage 45 which preferably is spaced from the surface of mail box 14 as shown in FIG. 5 but if desired it can be in actual contact with the external surfaces of mail box 14. In order to resist denting from the type of damage force ususally inflicted on mail boxes, cage 45 should have a nominal thickness of about $\frac{1}{8}$th inch but obviously still greater protection is obtained with increased thickness of the metal plate, i.e. $\frac{1}{4}$th to $\frac{1}{2}$ inch. Metals useful in the construction of metal plate cage 45 include steel, aluminum, brass, magnesium, copper, cast iron, and their alloys. Similarly, a plate cage 45 constructed of a plastic material and preferably a plastic material reinforced as for example by fiber glass cloth or fiber glass strands, carbon fibers or steel mesh requires a nominal thickness of at least about 3/16th inch.

As a substitute for metal in the construction of cages 10, 45, 46 and 59 the use of wood or high impact strength plastic materials is within the contemplation of this invention, provided that such materials are utilized in a manner as to provide impact protection substantially equivalent to that obtainable from the use of metal bars, metal plate, or metal pipes as shown in FIG. 11. As will be understood by those skilled in the art, generally to provide equivalent protection, the wood or plastic members, if of the same thickness as a metal cage member would have a width at least 3 to 5 times and perhaps more than that of the metal member in the instance of a bar type cage as illustrated in FIG. 3. Conversely, if it is desired to have the wood or plastics structural member of the same width as metal member, then their thickness should be a relatively high multiple of the metal thickness of the order of four or more depending on the flexural, tensile and compression strength values of the particular wood or plastic material. Among the suitable plastic materials useful for the construction of a cage enclosure according to the present invention are the polyolefins such as polyethylene, polypropylene and modified copolymers thereof, polyamides such as nylon 6—6, polycarbonates, polysufones, polyacrylics, vinyl halide polymers and copolymers, ABS polymers, epoxies, heat-hardenable phenol-aldehyde resins, urea-formaldehyde resins and melamine aldehyde resins. All of these plastics may be used in combination with impact reinforcing fillers such as glass fiber, nylon or polyester fiber, carbon fiber or metal fibers to further enhance their impact and flexural strengths. The plastic may be used as the binder component in laminated structures of paper, organic or inorganic fabric, or wood as in plywood structures.

Figure 7:
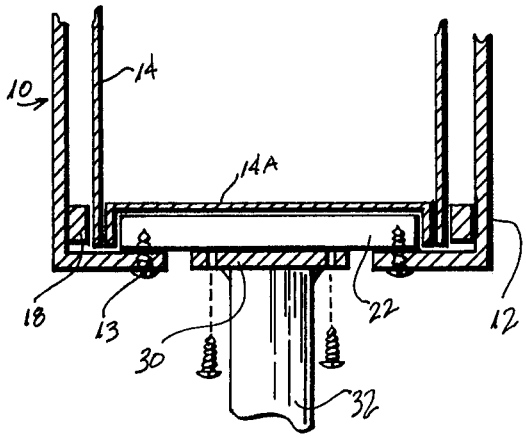
FIG. 7 is a fragmentary sectional view similar to FIG. 6 illustrating another form of bolster means for mounting a mail box enclosed by a protective cage to a mail box standard.

Referring to FIG. 7 there is shown another technique for mounting cage 10 to a mail box standard 32 and mounting plate 30. In this example the arched metal strap 12 is end lengthened and inwardly bent to form a right angle bend having aperture 13 therethrough to provide access for a screw to enter and to be screwed into the bottom surface of a rectangular shaped wood or compressed and bonded wood fiber bolster plate 22. In turn bolster plate 22 is screw attached to the top surface of mounting plate 30 which is normally face welded to the end of metal standard 32. Mail box 14 is fastened to bolster plate 22 and cage 10 by screws not shown passing through apertures 20 in bottom horizontal bar 18 and corresponding apertures in mail box 14 and into bolster plate 22.

Figure 8:
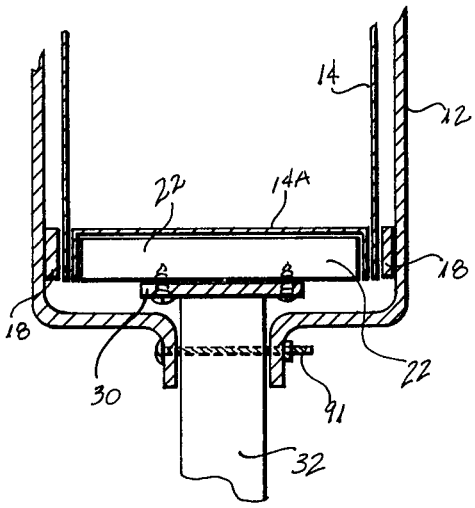
FIG. 8 is a fragmentary view similar to FIG. 7 and illustrates still another means for mounting a mail box enclosed by a protective cage to a mail box standard.

FIG. 8 illustrates a variation of the mounting techniques shown in FIG. 7. In this variation the middle arch bar member 12 has on each terminal end an inward right angle bend and then a downward right angle bend having an aperture therethrough enabling a bolt 91 to pass through it and correspondingly located apertures in metal standard 32 (or if desired a wood post) to the other end of arch member 12 and secured by a nut threaded onto the bolt. Mail box 14 is fastened to bolster plate 22 and cage 10 by screws (not shown) passing through apertures 20 in bottom horizontal bar 18. Bolster plate 22 is screw fastened to mounting plate 30.

FIG. 9 illustrates still another technique for obtaining a strong impact resistant attachment of cage 10 and mail box 14 to metal standard 32. As shown in FIG. 9 the middle arched metal bar 12 has at each end an inward right angle bend, each bend having an aperture 13 therethrough mating with corresponding apertures through mounting plate 30, bolster plate 22 and bottom plate **14*a* of mail box 14. Carriage bolts 21 are inserted through these apertures with their heads resting against the top surface of the mail box bottom plate 14*a* thus presenting a smooth top surface which does not interfere with placement of mail within mail box 14**.

FIG. 10 depicts a contemporary design mail box 55 having a hexagonal cross-section as mounted on a tubular metal standard 32. Mail box 55 has a bar type cage enclosure 57 with a hexagonal cross-section shape closely corresponding to the cross-section shape of mail box 55. Cage enclosure 57 other than for its cross-section shape utilizes the same materials of construction and assembly as previously described for cage 10 of FIG. 3. Accordingly, it is rather evident that the cage enclosures of this invention can be readily fabricated to match the configuration of any mail box whose design has been approved by the U.S. Postmaster General.

Still another form of cage enclosure utilizing the principles of this invention is illustrated by FIG. 11. Cage enclosure 59 of FIG. 11 is formed from steel or other suitable metal piping having a diameter of about 1½ to 3 inches and bent into an arch encompassing mail box 14. As shown in FIG. 11, cage 59 is constructed with two end arches 61, 63 and a middle arch 65. The terminal ends of each arch 61, 63 and 65 are butt welded to the horizontal flange of metal angle bar 67 as best shown in the somewhat enlarged view of FIG. 12. Apertures 20 are drilled or punched through the vertical flange of angle bar 67 to facilitate attachment of cage 59 to mail box 14 and the suitable bolster plate (not shown). Preferably as shown in FIG. 11 the end arch members 61, 63 respectively protrude from the front and rear ends of mail box 14, thus further enhancing protection of mail box 14 from damage when the impact force is primarily directed against the front or rear end of mail box 14 rather than its sides. It is to be understood that similar protection can be obtained from cages 10, 45, 46 and 57 by appropriately extending their front and rear end surfaces beyond the front and rear end surfaces of mail boxes 14 and 55.

Figure 17:
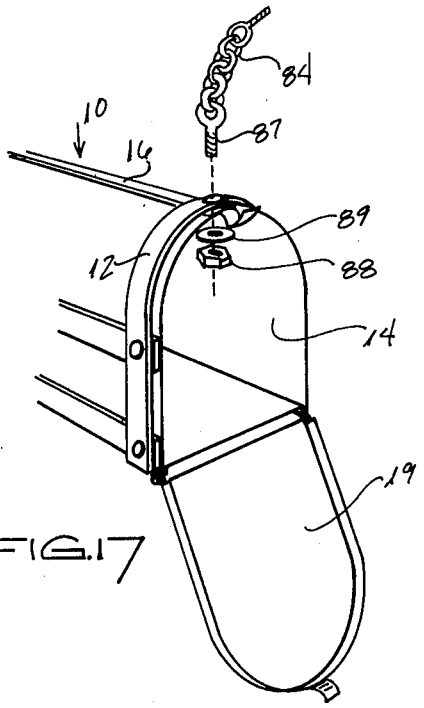
FIG. 17 is a fragmentary perspective view of the door end section of the mail box and cage depicted in FIG. 16 and illustrates the positioning of an eye bolt through the cage and mail box.
Figure 15:
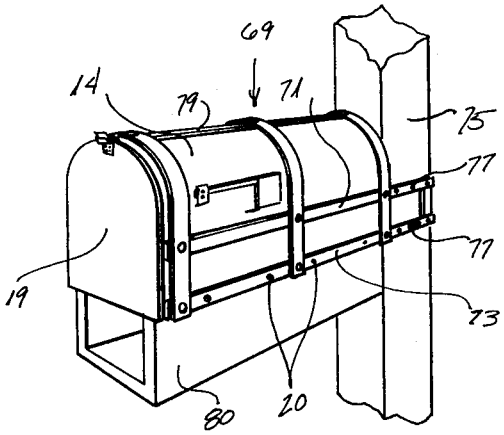
FIG. 15 is a perspective view of still another means for mounting a caged enclosed mail box to a vertical wood post standard wherein extensions of the horizontal cage straps are fastened to the sides of a vertical wood post.
Figure 16:
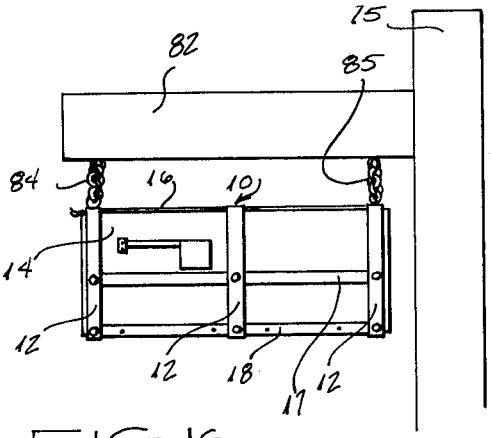
FIG. 16 is a plan view for a chain suspended mounting for a cage enclosed mail box to the cantilever beam of a wood post standard.

FIGS. 15 and 16 and 17 are of interest in showing the versatility of the cage enclosures of this invention for attachment to different types of mail box standards. In FIG. 15 there is shown a cage enclosure 69 similar to cage enclosure 10 except that the horizontal metal bars 71, 73 each have a rearward extension long enough to overlap each side face of wood post 75 thereby providing a cantilever form of mounting. Apertures 77 in the rear extensions of horizontal bars 71, 73 enable screw fastening of the bars to wood post 75. It is to be understood that top horizontal metal strap 79 can be similarly rearwardly extended and bent upwardly at a right angle to form an additional attachment means to wood post 75. While it is possible to attach cage 69 to mail box 14 by rivets or bolts passing through apertures 20 and corresponding apertures in the bottom side flanges of mail box 14 it is preferred to also include attachment to a bottom bolster plate such as shown in FIG. 13, or FIG. 14 in order to provide maximum impact resistance for mail box 14. The cantilever suspension of mail box 14 and cage 69 to wood post 75 can if desired be augmented by the presence of a horizontal wood or metal "U" channel beam 80 positioned underneath the mail box 14 and having its rear end attached to vertical post 75 as by straps, dowels, mortising and the like (not shown). The "U" channel beam 80 provides an enclosure for newspapers or other articles delivered by persons other than the mail carrier.

A chain type mounting of mail box 14 and cage 10 is illustrated by FIG. 16 and FIG. 17. Vertical wood post 75 has attached thereto a horizontal wood beam 82 extending somewhat beyond the front end of mail box 14 and cage 10. Near the front end of wood beam 82, one end of a chain 84 is attached thereto by means of a screw eye. The other end of chain 84 has an eye bolt 87 attached thereto and is insertable into mating apertures through the top of front arch member 12, top bar member 16 and the top of mail box 14. When thus inserted eye bolt 87 is retained in position by nut 88 and washer 89. The rear chain 85 is similarly fastened to the rear arch member 12 and top bar 16 of cage 10 and mail box 14. The mail box suspension attachment system illustrated in FIG. 16 and FIG. 17 as with the other attachment systems herein described is adequately effective in transmitting impact energy applied to cage 10 to mail box standard comprising beam 82 and vertical post 75. Moreover if the impact energy is of such magnitude as to cause cage 10 and mail box 14 to rotate around horizontal beam 82, there is no way contact can be made by the mail box surface with the surfaces of horizontal beam 82 because each of the three arch members 12 of cage 10 function as impact barrier spacers between the mail box surfaces and the surfaces of horizontal beam 82.

Tests were under controlled impact conditions to verify the protection given to size 1A rural mail boxes by cages according to this invention and more particularly a metal bar cage conforming to FIG. 3. One cage (A) was assembled from cold rolled steel bars of $\frac{1}{8}$th inch thickness and a width of $1\frac{1}{4}$ inches. Another cage (B) was assembled from cold rolled steel bars of $\frac{1}{4}$ inch thickness and a width of $1\frac{1}{4}$ inches. Each cage was fastened to a rural mail box and to a molded wood fiber bolster plate (22) positioned within the exterior bottom cavity of the mail box by screws passing through apertures 20 along each side of the mail box. The rural boxes used in the tests were with one exception manufactured in accordance with shop drawing C-3730-0310 RD5, Code Indent. 27085 of the U.S. Postal Service, as approved by the Project Engineer on Mar. 22, 1976. The exception was a commercial mail box simulating a barn structure and made entirely from structural foam molded polyethylene, having an average wall thickness of $\frac{1}{4}$ inch.

Each mail box was placed on a concrete floor with the bottom edges of the box against the concrete floor surface. As the impact means, a steel angle bar, $83\frac{1}{2}$ inches long $\frac{3}{8}$ inch thickness and weighing 55 pounds was positioned so that one end rested on a flat support of the same height as the mail box, i.e. 11 inches and the other end extended over the door end of the mail box for a depth of 6 inches in a direction towards the rear of the box. The end of the angle bar resting on the front door end of the mail box was then lifted to a height of $3\frac{1}{2}$ feet above the floor and then permitted to fall freely on the mail box. After the angle bar had struck the top front end of the mail box, measurements were taken to determine the amount of distortion suffered by the mail box and whether or not the mail box door would open and close satisfactorily. Prior to the impact tests, all the mail boxes with the exception of the molded foamed polyethylene box, had a width of $7\frac{3}{4}$ inches between the parallel walls of the mail box and their doors functioned in a normal manner. The test result obtained at room temperatures are set forth in the following table.

DEFORMATION RESISTANCE TEST

| Type of mail box | Cage Protection | Maximum Outward Deformation of box side walls | Door Function |
|---|---|---|---|
| Standard 1A | None | $10\frac{1}{2}$" | Inoperable |
| Standard 1A | Cage A | 8 1/16" | Satisfactory* |
| Standard 1A | Cage B | none | Satisfactory |
| Standard 1A (commercial standard 1A, having a decorative $\frac{1}{8}$ inch thick molded fiber glass covering) | None | $9\frac{3}{4}$" | Inoperable |
| Commercial simulated barn of foamed polyethene. | None | None; 6" long longitudinal crack | Satisfactory |

*The slight deformation of the side walls made closing of the door somewhat more difficult than normal. This resistance to closing was eliminated by manual bending of the side walls to their original position.

Although the mail box made of foamed molded polyethylene still had a functioning mail door, the 6 inch longitudinal crack would permit rain entry into the mail box and thus would be unsatisfactory. In as much as some plastic materials become rather brittle when exposed to low winter temperatures, another sample of this molded mail box was placed in cold storage for 12 hours at −12° F. Immediately after such cold exposure, the foamed polyethylene mail box was tested in the same manner as the other mail boxes and this time the top of the box near the front door broke into three sizeable pieces, including a piece containing a magnetic door latch. Thus while the door could still be opened and closed, the absence of the magnetic door latch kept the door from being held in a closed position and thus would be rejected by the U.S. Postal Service from receiving mail delivery.

Although the above described impact tests were not conducted with the mail boxes mounted on a conventional mail box standard, it should be noted that the concrete floor surface on which the mail boxes were resting when struck by the angle bar functioned as a standard for supporting the boxes. Thus in the instances of the two mail boxes protected by a cage structure of this invention the impact force received by the cage structure was transmitted primarily to the concrete floor surface as evidenced by the minimiscule side wall deformation of the mail boxes enclosed by said cages.

It should be understood that the principles and nature of this invention can be readily adopted by those skilled in the art not only to metal mail boxes but also to those made from other materials of construction such as wood or plastics and of widely different configurations without departing from the spirit of the disclosure or from the scope of the appended claims.

Having thus described the invention, what is claimed as new and desired to be secured by Letters Patent is:

1. The combination of a rural type mail box having a flanged exterior bottom cavity, a bolster plate positioned in said cavity and an impact resistant cage exteriorly surrounding said mail box, said cage comprising a plurality of spaced horizontal impact resistant structural members extending from the front to the rear of said mail box, the bottom horizontal structural member on each side of said mail box being adjacent to a flange of said cavity and a plurality of spaced impact resistant members each being formed into an arch extending over the top of the mail box with the legs of each arch terminating at the base of the mail box, each horizontal member being rigidly fastened to each arch member and with each bottom horizontal member being rigidly fastened to an adjacent flange on the mail box and to the bolster plate in said bottom cavity, said horizontal members and said arch members each having an impact resistance equivalent at least to cold rolled steel member of $\frac{1}{8}$ inch thickness and $1\frac{1}{4}$ inch width.

2. The combination of a rural type mail box, a bolster plate and an impact resistant cage as recited in claim 1 wherein one of the plurality of arch members is positioned at the front of the mail box and another arch member is positioned at the rear of the box and all the arch members overlap the horizontal structural members.

3. The combination of a rural type mail box, a bolster plate and an impact resistant cage as recited in claim 2 wherein each horizontal member and each arch member is formed from cold rolled steel bars having a thickness of at least $\frac{1}{8}$ inch and a width of at least $1\frac{1}{4}$ inches.

4. The combination of a rural type mail box, a bolster plate and an impact resistant cage as recited in claim 3 wherein one of the horizontal structural members is positioned adjacent to the uppermost surface of the mail box.

* * * * *